US005351455A

United States Patent [19]

Schoonover et al.

[11] Patent Number: 5,351,455

[45] Date of Patent: Oct. 4, 1994

[54] METHOD AND APPARATUS FOR WALLBOARD ATTACHMENT

[75] Inventors: Douglas J. Schoonover, Redondo Beach; Michael W. Doane, San Diego, both of Calif.

[73] Assignee: American ConForm Industries, Inc., Santa Ana, Calif.

[21] Appl. No.: 118,657

[22] Filed: Sep. 10, 1993

Related U.S. Application Data

[63] Continuation-in-part of Ser. No. 45,678, Apr. 9, 1993, abandoned.

[51] Int. Cl.[5] ..... E04B 5/00

[52] U.S. Cl. ..... 52/410; 52/426; 52/353

[58] Field of Search ..... 52/410, 426, 712, 720, 52/361, 362, 363, 353; 411/460, 401, 458, 459, 469; 16/4, 10, 16

[56] References Cited

U.S. PATENT DOCUMENTS 3,855,750 12/1974 Reiland ..... 52/363

4,455,794 6/1984 MacKinnon, Jr. et al. ..... 52/410 X

*Primary Examiner*—Carl D. Friedman

*Assistant Examiner*—Creighton Smith

*Attorney, Agent, or Firm*—Mason, Fenwick & Lawrence

[57] ABSTRACT

A method and apparatus for attaching sheets of wallboard to an EPS side panel and concrete wall assembly. A metal fastener strip is positioned against the outer surface of the outwardly facing side panels with its upper edge a predetermined distance below the ceiling line, prior to pouring of the concrete. Nails are pushed through longitudinally spaced-apart holes in the metal strip with their tips projecting well into the cavity defined between the opposed side panels. The concrete, when placed and cured, captures the nails, creating a mechanical connection to the metal strip. After the concrete is placed and cured, an adhesive is spread over the outwardly facing panels and the sheet of wallboard is placed in position. The wallboard is secured to the panels by hammering self-tapping drywall screws into the metal strip. The holes in the metal strip are countersunk to define a concentric recess around each hole, the metal strip being pushed into the side panels so that the recesses project into the panels. The heads of the nails fit flush within the recesses. The nails are secured against movement during placement of the concrete by placing speed washers over their tips and pressing the speed washers against the inner surface of the outwardly facing side panels.

11 Claims, 1 Drawing Sheet

METHOD AND APPARATUS FOR WALLBOARD ATTACHMENT

This application is a continuation-in-part of U.S. patent application Ser. No. 08/045,678, filed Apr. 9, 1993, now abandoned.

BACKGROUND OF THE INVENTION

1. Field of the Invention

The present invention relates to modular concrete building forms. More specifically, the invention relates to a method and apparatus for fastening a sheet of gypsum wallboard or the like to a modular concrete building form.

2. Related Art

The use of synthetic plastic modular building block forms to construct concrete walls is becoming increasingly popular, not just in the United States, but in many European countries as well. Typically, a pair of parallel, spaced-apart side panels, formed from a material such as expanded polystyrene (EPS), are held together by a plurality of struts or ties, and are provided with interlocking upper and lower surfaces to permit stacking. The cavity between the side panels receives poured concrete, to form a building wall assembly. U.S. Pat. No. 4,730,422 to Young and U.S. Pat. No. 4,884,382 to Horobin are illustrative of this type of building wall assembly, and are incorporated herein by reference in their entireties.

Although the EPS side panel and concrete building wall assembly is simple and convenient to erect, it is not in and of itself a complete wall structure. Many, if not all, building codes require that such wall assemblies be separated from habitable space by a thermal barrier, generally a 15 minute thermal barrier. This requirement is satisfied by installation of ½ inch thick gypsum wallboard, provided that the attachment method also satisfies the required 15 minute thermal index.

Section 3.1.2 of the ICBO-Evaluation Service, Inc. "Acceptance Criteria for Foam Plastic Insulation," dated April 1992, stipulates that ½ inch gypsum wallboard installed in conformance with table 47-G of the Uniform Building Code is a complying thermal barrier. This attachment schedule requires that the gypsum wallboard be secured by drywall screws on a 16 inch O.C.E.W. pattern requiring 28 screws per 4 foot by 8 foot sheet of drywall. Alternate attachment methods can be employed when tested in compliance with UBC Standard 17-5 (Section 5.2.1 of the above-mentioned "Acceptance Criteria").

Simply securing the wallboard to the EPS side panel is insufficient, as at the temperature levels encountered in a fire, the EPS side panel will melt, and the wallboard will fall away from the concrete interior. Young proposes a method for securing furring strips to the EPS panel (illustrated in FIG. 9) by driving the wood screws into the T-shaped ends of the ties which are embedded in the EPS panel. However, because the T-shaped ends of the ties are embedded within the EPS panel, I-shaped markers (illustrated in FIG. 6), must be provided on the exterior of the EPS panel to permit the builder to locate the T-shaped ends. This method is inconvenient to execute, because once the furring strips are in place over the I-shaped indicia, the I-shaped indicia are hidden, so as to make placement of the wood screws a matter either of guess-work or repeated measurement.

It is the solution to this and other problems to which the present invention is directed.

SUMMARY OF THE INVENTION

It is therefore a primary object of the present invention to provide a method and apparatus for attaching a sheet of wallboard to a sheet of foam plastic or similar material which will satisfy a thermal index of a given time period, for example, 15 minutes.

It is another object of the present invention to provide a method and apparatus for attaching a sheet of wallboard to a sheet of plastic foam or similar material which is simple to use and avoids the need for excessive measurement.

It is still another object of the present invention to provide a method and apparatus for attaching a sheet of wallboard to a sheet of plastic foam or similar material which eliminates the need for the customary furring channels and furring stripe commonly required for attaching sheets of wallboard.

These and other objects of the present invention are achieved by the provision in an EPS side panel and concrete wall assembly of a fastener strip mechanically connected both to the EPS side panel and to a sheet of wallboard. The EPS side panel and concrete building wall assembly comprises a plurality of stacked, opposed side panels having a core of concrete formed therebetween.

A metal fastener strip is positioned against the outer surface of the outwardly facing side panels with its upper edge a predetermined distance below the ceiling line, prior to pouring of the concrete. The metal strip has longitudinally spaced-apart holes formed therein at equal intervals.

Nails are pushed through the holes in the metal strip with their tips projecting well into the cavity defined between the inner surfaces of the opposed side panels. The concrete, when placed and cured, captures the nails, creating a mechanical connection to the metal strip.

After the concrete is placed and cured, an adhesive is spread over the outwardly facing panels and the sheet of wallboard is placed in position. The wallboard is secured to the panels by screwing self-tapping drywall screws into the metal strip.

In one aspect of the invention, the holes in the metal strip are countersunk to define a concentric recess around each hole; and the metal strip is pushed into place into the side panels so that the recesses of the countersunk holes project into the panels. The heads of the nails fit flush within the recesses.

In another aspect of the invention, the nails are secured against movement during placement of the concrete by placing speed washers over their tips and pressing the speed washers against the inner surface of the outwardly facing side panels.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
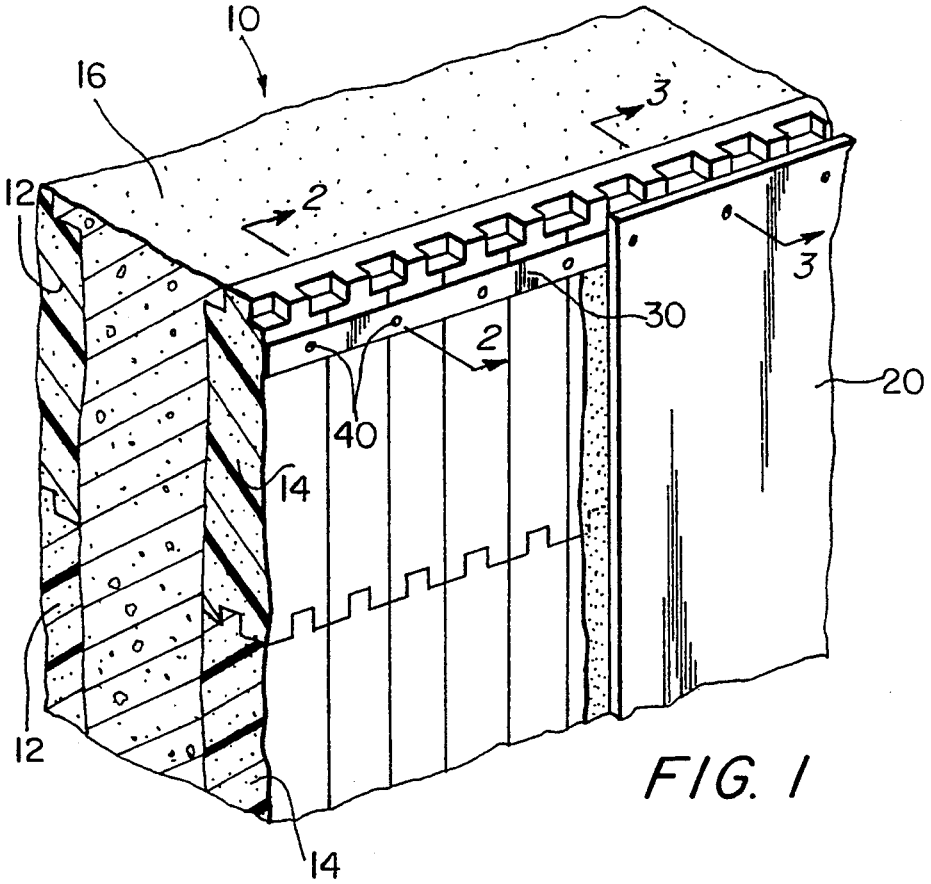
FIG. 1 is a perspective view, partially broken away, showing an EPS side panel and concrete building wall assembly having a sheet of wall board attached thereto in accordance with the method and apparatus of the present invention.

In describing preferred embodiments of the present invention illustrated in the drawings, specific terminology is employed for the sake of clarity- However, the invention is not intended to be limited to the specific terminology so selected, and it is to be understood that each specific element includes all technical equivalents which operate in a similar manner to accomplish a similar purpose.

Referring now to FIG. 1, there is shown an EPS side panel and concrete building wall assembly 10 of the type disclosed in U.S. Pat. No. 4,884,382 to Morobin. This assembly comprises a plurality of stacked, opposed side panels 12 and 14 having a core of concrete 16 formed therebetween. Opposed side panels 12 and 14 are held together by struts (not shown), and are closed at their ends by end panels (also not shown).

In order to enable acceptable attachment of a sheet of wallboard 20 to side panels 14, a metal strip 30 is positioned with its upper edge a predetermined distance, preferably two inches, below the ceiling line, prior to pouring of concrete 16. In a preferred embodiment, strip 30 is a 1½ inch wide metal strip, preferably 24 gauge (0.022 inch) aluminum strip or 26 gauge (0.0217 inch) galvanized steel strip; it is thus flexible, both for ease of installation, and to permit it to be easily rolled for shipment.

Figure 2:
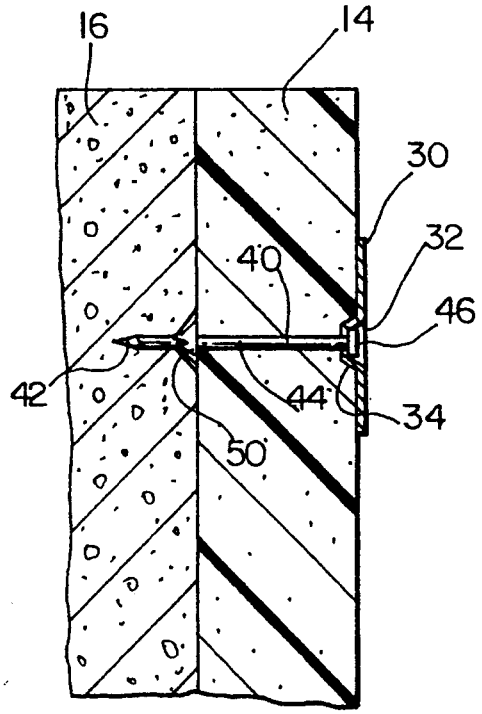
FIG. 2 is a cross-sectional view, taken along line 2—2 of FIG. 1.

Metal strip 30 is provided with evenly-spaced holes 32, which are countersunk to define a concentric recess 34 around each hole 32. In a preferred embodiment, holes 32 are approximately 0.200 inch diameter at approximately 10 inches on center (o.c.); and recess 34 at its inner surface has a diameter of approximately 0.335 inch, and at its outer surface has a diameter of approximately 0.525 inch. Metal strip 30 is pushed into place into adjacent side panels 14 so that, as shown in FIG. 2, recesses 34 of countersunk holes 32 project into panels 14.

Once metal strip 30 is in place, nails 40 are pushed through holes 32. Nails 40 must be sufficiently long that their tips 42 will project well into the cavity defined between the inner surfaces of opposed panels 12 and 14. In a preferred embodiment, **16*d* nails are used. The size of holes 32 and nails 40 are coordinated so that the shanks 44 of nails 40 can easily pass through holes 32 and penetrate through strip 30; while the heads 46 of nails 40 will fit flush with the mounting (i.e., the outer) surface of strip 30**.

In order to secure nails 40 against movement during placement of concrete 16, a speed washer 50 is placed over tip 42 of each nail 40 and pressed against the inner surface of panel 14. The concrete 16, when placed and cured, captures nails 40, creating a mechanical connection to metal strip 30.

Figure 3:
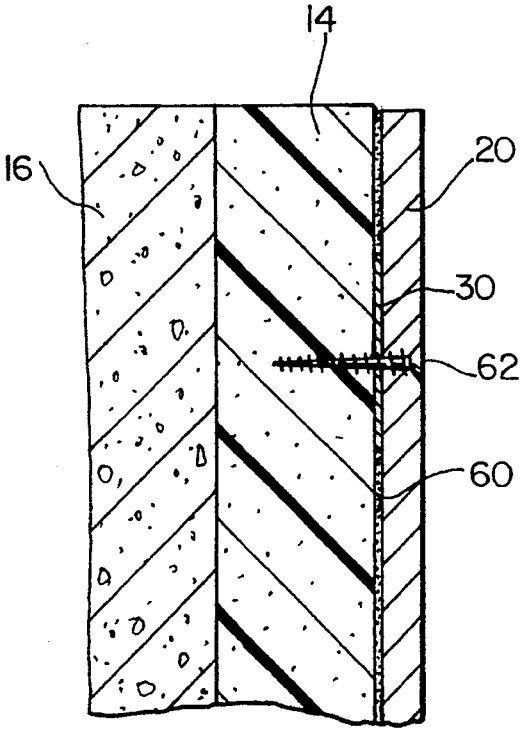
FIG. 3 is a cross-sectional view, taken along line 3—3 of FIG. 1.

After concrete 16 is placed and cured, an adhesive 60 is spread over the panels 14 and the sheet of wallboard 20 is placed in position. Wallboard 20 is also, in accordance with the invention, secured to panels 14 by screwing self-tapping drywall screws 62 into metal strip 30, as shown in FIG. 3. Preferably, screws 62 are placed at 12 inches o.c. Thus, a mechanical connection is provided between wallboard 20 and concrete 16, because wallboard 20 is secured to metal strip 30 through screws 62, and metal strip 30 is secured to concrete 16 through nails 40.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A wall assembly comprising:

a support sheet having an upper edge, an inner surface, and an outer surface;

a elongated fastener strip having a plurality of holes formed therein evenly spaced apart lengthwise, said fastener strip being placed against said outer surface of said support sheet parallel to said upper edge thereof;

a plurality of nails, said nails having shanks, and heads and tips at opposite ends of said shanks, said shanks being longer than said thickness of said support sheet, and said heads having a larger diameter than said holes, one said nail being inserted through each of said holes with said shank extending through said support sheet and said tips extending beyond said inner surface of said support sheet;

a plurality of washers, one said washer being placed over each of said tips of said nails and pushed against said inner surface of said support sheet;

an outer sheet having an inner surface and an outer surface, said inner surface of said outer sheet being placed against said outer surface of said support sheet; and a plurality of elongated fasteners extending from said outer surface of said outer sheet through said outer sheet and into and through said fastener strip at spaced-apart intervals.

2. The assembly of claim 1, wherein said holes in said fastener strip are countersunk to define a concentric recess about each said hole, and wherein said heads of said nails are dimensioned to fit within said recesses.

3. The assembly of claim 1, wherein said fastener strip is spaced downwardly from said upper edge of said support sheet.

4. The assembly of claim 1, further comprising a concrete panel formed rearwardly of and abutting said inner surface of said support sheet and encasing said tips of said nails.

5. A method of fastening an outer sheet of material to a support sheet, said method comprising the steps of:

(a) providing a support sheet having an upper edge, an inner surface, and an outer surface;

(b) providing an outer sheet having an inner surface and an outer surface;

(c) providing an elongated fastener strip having a plurality of holes formed therein evenly spaced apart lengthwise;

(d) providing a plurality of nails, the nails having shanks, and heads and tips at opposite ends of the shanks, and the heads having a larger diameter than the holes;

(e) placing the fastener strip against the outer surface of the support sheet parallel to the upper edge thereof;

(f) following said step (e), inserting the nails through the holes with their shanks extending into the support sheet and the tips extending beyond the inner surface of the support sheet;

(g) placing the inner surface of the outer sheet against the outer surface of the support sheet; and (h) driving elongated fasteners through the outer sheet, the fastener strip, and the support sheet at spaced-apart intervals.

6. The method of claim 5, further comprising the step of:

(i) following said step (g) and prior to said step (g), placing a layer of adhesive between the outer surface of the support sheet and the inner surface of the outer sheet.

7. The method of claim 5, wherein the shanks of the nails are longer than the thickness of the support sheet, and in said step (f) the nails are inserted through the holes with their shanks extending through the support sheet and their tips extending beyond the inner surface of the support sheet; and further comprising the steps of:

(i) following said step (f) and prior to said step (g), placing washers over the tips of the nails; and (J) following said step (i) and prior to said step (b), pushing the washers against the inner surface of the support sheet.

8. The method of claim 5, wherein the shanks of the nails are longer than the thickness of the support sheet, and in said step (f) the nails are inserted through the holes with their shanks extending through the support sheet and their tips extending beyond the inner surface of the support sheet; and further comprising the step of:

(i) following said step (f) and prior to said step (g), forming a concrete panel rearwardly of and abutting said inner surface of support sheet to encase the tips of the nails.

9. The method of claim 5, wherein the shanks of the nails are longer than the thickness of the support sheet, and in said step (f) the nails are inserted through the holes with their shanks extending through the support sheet and their tips extending beyond the inner surface of the support sheet; and further comprising the steps of:

(i) following said step (f) and prior to said step (g), placing washers over the tips of the nails;

(J) following said step (i) and prior to said step (g), pushing the washers against the inner surface of the support sheet; and (k) following said step (j) and prior to said step (g), forming a concrete panel rearwardly of and abutting said inner surface of support sheet to encase the tips of the nails.

10. The method of claim 12, further comprising the step of:

(1) following said step (k) and prior to said step (g), placing a layer of adhesive between the outer surface of the support sheet and the inner surface of the outer sheet.

11. The method of claim 5, wherein the holes in the fastener strip are countersunk to define a concentric recess about each hole, and wherein in said step (e), the fastener strip is pressed against the outer surface of the support sheet to embed the recesses in the support sheet.

* * * * *